US006138847A

United States Patent [19]

Johnson

[11] Patent Number: 6,138,847

[45] Date of Patent: Oct. 31, 2000

[54] DISPOSABLE NON-REUSABLE BABY BOTTLE

[76] Inventor: Russell Joe Johnson, 601 S. Vista La. #40, Edmond, Okla. 73034

[21] Appl. No.: 09/257,662

[22] Filed: Feb. 25, 1999

[51] Int. Cl.[7] ..... A61J 9/00

[52] U.S. Cl. ..... 215/11.1; 215/11.6; 215/263

[58] Field of Search ..... 215/11.1, 11.6, 215/263

[56] References Cited

U.S. PATENT DOCUMENTS

| | | | |
|---|---|---|---|
| 1,175,054 | 3/1916 | Dunfee | 215/11.1 |
| 1,668,227 | 5/1928 | Beck | 215/11.1 |
| 2,531,570 | 11/1950 | Hofman | 215/11.1 |
| 3,214,053 | 10/1965 | Roberson et al. | 215/11.1 |
| 3,219,221 | 11/1965 | Ballin | 215/11.6 |
| 3,335,890 | 8/1967 | Grunkmann et al. | 215/11.1 |
| 3,468,445 | 9/1969 | Ballin | 215/11.6 |
| 3,531,009 | 9/1970 | Saperstein | 215/11.6 |
| 3,572,533 | 3/1971 | Koll | 215/11.6 |
| 3,655,083 | 4/1972 | Eberhardt et al. | 215/11.6 |
| 3,804,952 | 4/1974 | McDonald | 215/11.6 |
| 4,676,386 | 6/1987 | Phlaphongphanich . | |
| 4,830,251 | 5/1989 | Conrad | 215/11.6 X |
| 5,244,105 | 9/1993 | Serre | 215/11.5 |
| 5,687,861 | 11/1997 | Wiedemann | 215/11.1 X |
| 5,688,238 | 11/1997 | Moser et al. . | |
| 5,819,964 | 10/1998 | Grimard | 215/263 X |
| 5,862,931 | 11/1997 | Mouchmouchian | 141/319 |

*Primary Examiner*—Stephen P. Garbe
*Assistant Examiner*—Tri M. Mai
*Attorney, Agent, or Firm*—Exclusivity-Law, Inc.; James T. Robinson

[57] ABSTRACT

A disposable non-reusable baby bottle provides a container having a rigid flange at the container's open end, a nipple having a radially enlarged flange, and a snap ring which locks the nipple to the open end of the container. The nipple is invertible between a storage position wherein the nipple extends into the container and a ready-to-use position wherein the nipple is accessible to a nursing infant. The snap ring includes a snap ring sealing ridge which protrudes into the radially enlarged flange of the nipple to increase resistance to removal of the nipple following use. In an alternate embodiment, the container rigid flange includes a second sealing ridge which protrudes into the radially enlarged flange of the nipple to further increase resistance of the nipple to removal. A safety seal prevents contamination of the nipple by covering the nipple when the nipple is in the storage position.

18 Claims, 6 Drawing Sheets

10
12
13
14
20
24
28
D

DISPOSABLE NON-REUSABLE BABY BOTTLE

BACKGROUND OF THE INVENTION

1. Field of the Invention

This invention relates to a disposable non-reusable baby bottle, and more particularly, but not by way of limitation, to a disposable non-reusable baby bottle which serves as a shipping and storage container for liquids to be consumed by infants.

2. Discussion

Baby bottles are well known in the art. Conventional baby bottles (also referred to herein as infant feeding systems or feeding systems) include a glass or plastic container having an externally threaded container opening, a bottle feeding nipple, and a screw-on top for securing the nipple to the container. Both the container and the nipple are reusable. A standard nipple, which is defined herein to mean a feeding nipple of the type commonly used with reusable baby bottles utilizing screw-on caps, is commonly made of either natural or synthetic rubber, both of which are flexible and compressible. Standard nipples are available for premature infants, newborns, and toddlers. An opening in the tip end (also referred to as the mouth portion) of the nipple permits liquid to be withdrawn from the container in response to a sucking action by the nursing infant. The size of the opening in the tip end of the nipple (also referred to as the nipple opening) varies. For a premature baby, the nipple opening is typically a small pinhole. For older infants and toddlers, the nipple opening is often in the form of a cross-cut or "X" to permit the infant to receive more liquid in response to the sucking action.

Care givers normally feed infants milk, formula, juices, and water from a baby bottle. In addition, some infants—especially older infants—receive dilute mixtures such as cereal-formula or thinned vegetables via baby bottle. As used herein, the terms "liquid" and "beverage" are used interchangeably to include all forms of nutrition capable of administration to infants through a nipple.

Not all baby bottles use rigid containers. In one baby bottle, a disposable container made of plastic film is deployed within a container shell. The open end of the disposable container folds across an end of the container shell and is secured by a flexible rubber nipple which clamps the disposable container in place. In this feeding system, the container is disposable but the nipple and shell are reusable.

Reusable baby bottles are major sources of concern for parents and other care givers. Bottle preparers must properly clean and sterilize baby bottles, bottle feeding nipples, and caps to prevent introduction of harmful contaminants into infant formula and other beverages to be consumed by the infant. The sterilization process is time consuming; moreover, the bottle preparer may fail to clean a reusable baby bottle thoroughly and thereby place the infant at risk.

Preparation of the beverage also presents risks. Formula and juices frequently require dilution of a concentrate using water. A simple mistake in understanding directions or in the measurement of the ingredients of an infant beverage may subject the infant to gastric distress or nutritional imbalances. Although some contaminants and bacteria are not harmful to adults, infants are especially sensitive because their systems have not yet fully developed. Dilution water, and ordinary tap water in particular, may contain trace amounts of minerals or bacteria which are harmful to infants. Chlorination of drinking water, although common throughout most of the United States, is not universal. Water systems in remote locations often lack the chlorine residual necessary to sanitize the water for drinking purposes. While the use of bottled water reduces the risk of contamination, bottle preparers may not seal the bottled water between uses.

Assuming the bottle preparer properly sterilizes bottle parts and correctly dilutes the concentrated infant beverage with suitable dilution water, reusable baby bottles present additional problems. The bottle preparer may incorrectly estimate the amount of formula a baby may need, resulting in wasted formula. Prepared baby bottles must be refrigerated prior to use, which in turn creates inconvenience and expense for transporting a baby bottle. Baby bottles also tend to leak through the nipples when the baby bottles are subjected to mechanical forces, causing clothes and other objects to be stained or damaged by the leaking beverage.

Users/preparers must periodically replace bottle feeding nipples, bottles, and caps. Many grocery stores and convenience stores which sell infant beverages do not sell the baby bottle parts. This presents a further inconvenience for the bottle preparer.

SUMMARY OF THE INVENTION

The present invention relates to a disposable non-reusable baby bottle which serves as both shipping container and feeding system for ready-to-use liquids. The disposable non-reusable baby bottle provides a generally cylindrical container having an opening at one end, a nipple, and a snap ring which locks the nipple to the open end of the container. The present invention eliminates cleaning and sterilizing of conventional baby bottle containers, nipples, and screw tops. The disposable non-reusable baby bottle also eliminates beverage preparation and refrigeration of the filled baby bottle. When filled with premixed liquid, the disposable non-reusable baby bottle is ready to use when the nursing infant is ready to eat. Contents of the disposable non-reusable baby bottle can be controlled precisely at the factory. For example, the factory can purify water efficiently and economically on a large scale for mixing with infant nutrients.

The disposable non-reusable baby bottle of the present invention is sealed to prevent spoilage, so refrigeration is unnecessary. Many infant beverages, including milk and orange juice, are perishable and may not be left unsealed at ambient temperatures because they become unfit for infant consumption.

Factory preparation of the formula permits date-stamping of the disposable non-reusable baby bottle (and its contents), thereby providing valuable information to parents and care givers regarding the sealed contents of the disposable non-reusable baby bottle.

One object of the present invention is to provide a disposable non-reusable baby bottle suitable for prefilling with ready-to-use infant beverages.

Another object of the present invention is to provide a disposable non-reusable baby bottle which eliminates preparation of the infant beverage at the point of use.

Another object of the present invention is to minimize the risk of contamination of infant beverages.

Still another object of the present invention is to provide a disposable non-reusable baby bottle which is factory-sealed and leak-resistant.

A still further object of the present invention is to provide a feeding system which ensures proper proportioning of water and nutrients in infant beverages.

Yet another object of the invention is to maximize formula usage efficiency by preventing the bottle preparer from overestimating the amount of formula to be prepared for the nursing infant.

Another object of the invention is to provide a bottle feeding system which will indicate tampering.

Other objects, features, and advantages of the present invention will become clear from the following description of the preferred embodiment when read in conjunction with the accompanying drawings and claims.

DETAILED DESCRIPTION OF THE INVENTION

In the following description of the invention, like numerals and characters designate like elements throughout the figures of the drawings.

Figure 3:
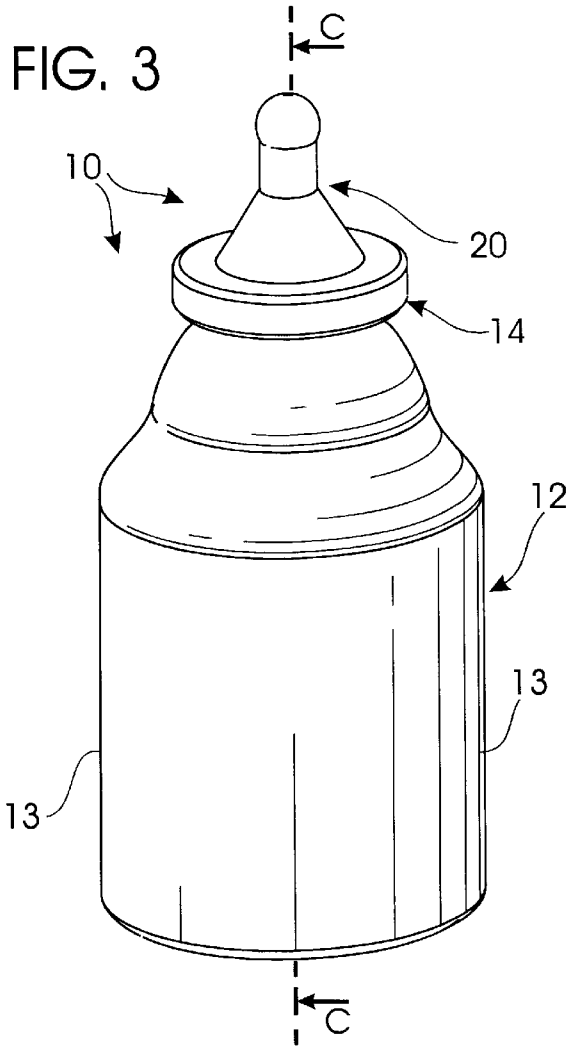
FIG. 3 is a pictorial view of the disposable non-reusable baby bottle of the present invention showing the nipple in a ready-to-use position.
Figure 2:
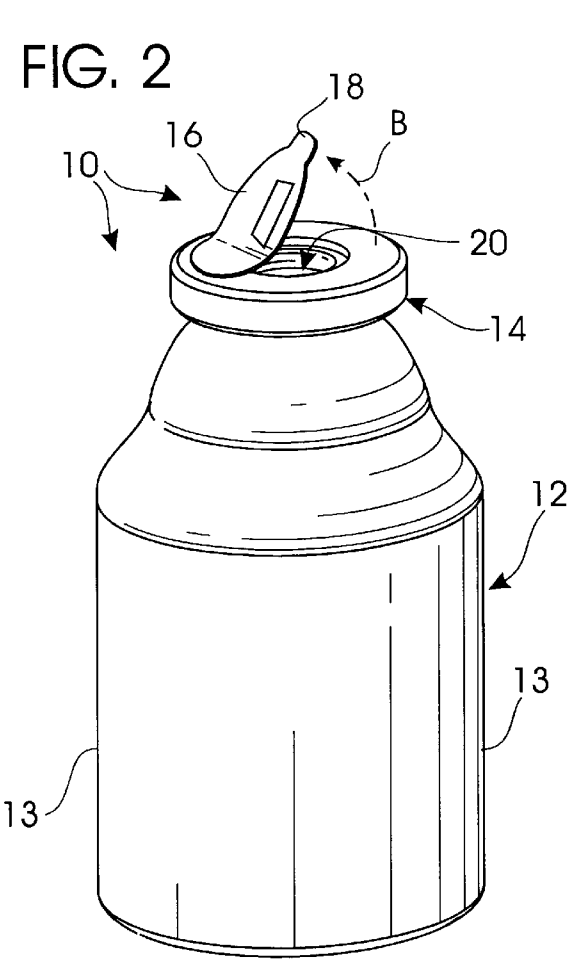
FIG. 2 is a pictorial view of the disposable non-reusable baby bottle of the present invention showing removal of the safety seal.
Figure 1:
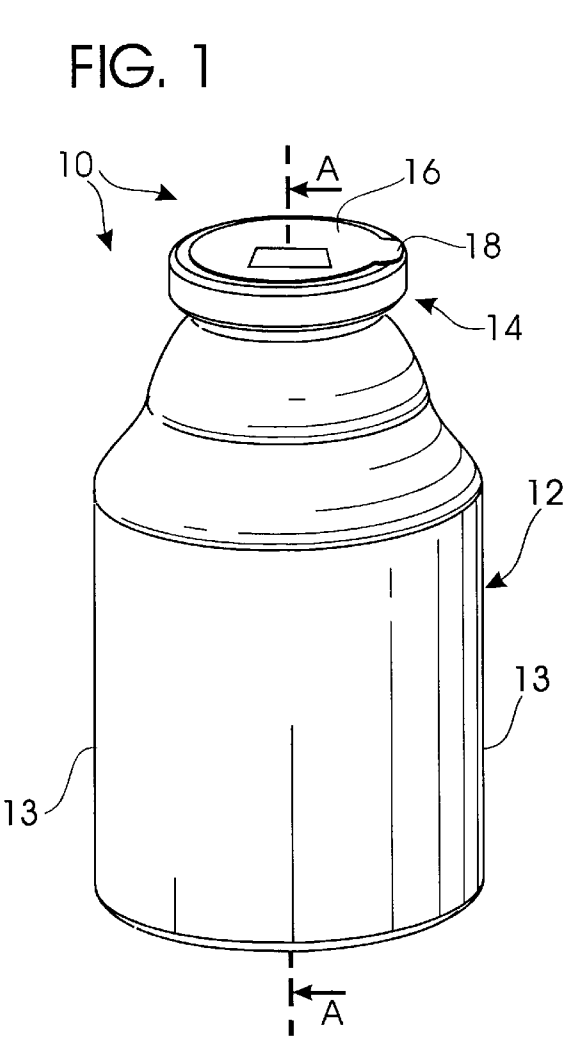
FIG. 1 is a pictorial view of the disposable non-reusable baby bottle of the present invention showing an unopened safety seal.

Referring generally to the drawings and more particularly to FIGS. 1–3, the disposable non-reusable baby bottle 10 includes a generally cylindrical container 12 with flexible sidewalls 13, a snap ring 14, a safety seal 16 having a pull tab 18, and a nipple 20. The nipple 20, shown in a use position (sometimes referred to herein as a ready-to-use position) in FIG. 3, is inverted within the snap ring 14 for storage as show in FIG. 2. The nipple is invertible between the storage position of FIG. 2 and the use position of FIG. 3. The arrow B (FIG. 2) indicates the direction of a force applied to the pull tab 18 of the safety seal 16 by the care giver to gain access to the nipple 20. The generally cylindrical container 12 will also be referred to herein as the container 12.

Referring now to FIGS. 1–2, the safety seal 16 prevents contaminants from coming in contact with the nipple 20 when the nipple 20 is in the storage position.

Figure 4:
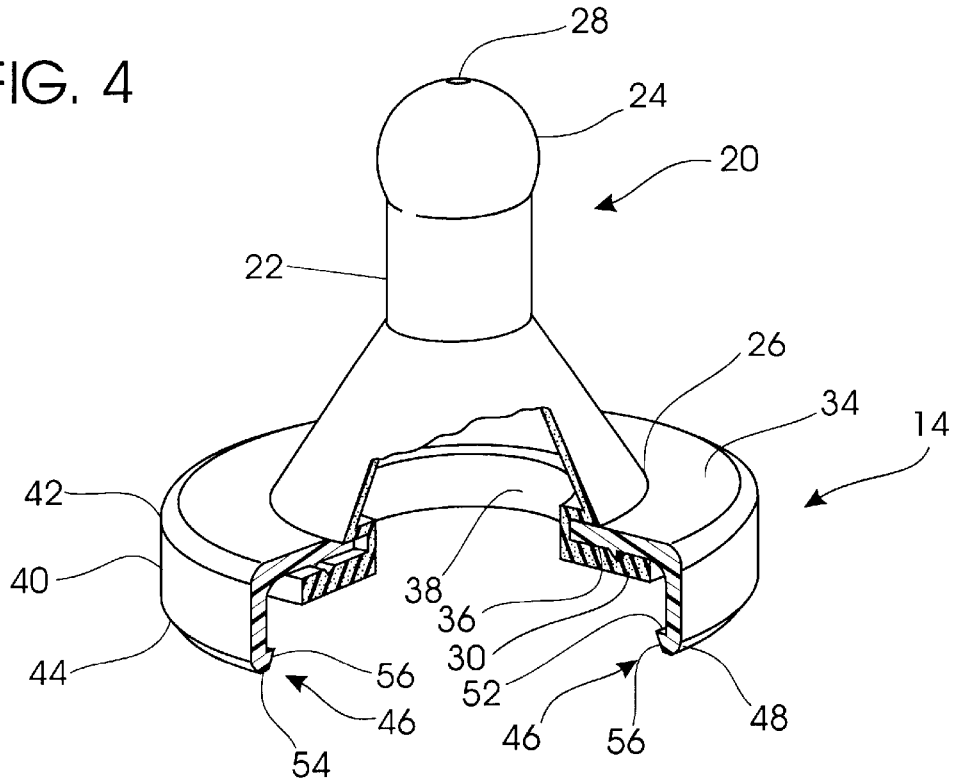
FIG. 4 is a partially cutaway view of a snap ring and nipple of the present invention with portions removed for clarity.

Referring now to FIG. 4, the snap ring 14 is shown with the nipple 20 in the ready-to-use position. The nipple 20 includes a flexible tubular body 22, a tip end 24, a base end 26, a nipple opening 28 in the tip end 24 of the nipple 20, and a radially enlarged flange 30 in the base end 26. The nipple 20 is a standard nipple, which is defined herein to mean a feeding nipple of the type commonly used with reusable baby bottles utilizing screw-on caps. Standard nipples are commonly made of either natural or synthetic rubber, both of which are flexible and compressible.

Still referring to FIG. 4, the nipple opening 28 in the tip end 24 permits liquid to be withdrawn from the container in response to a sucking action applied to the tip end 24 by the nursing infant.

Figure 10:
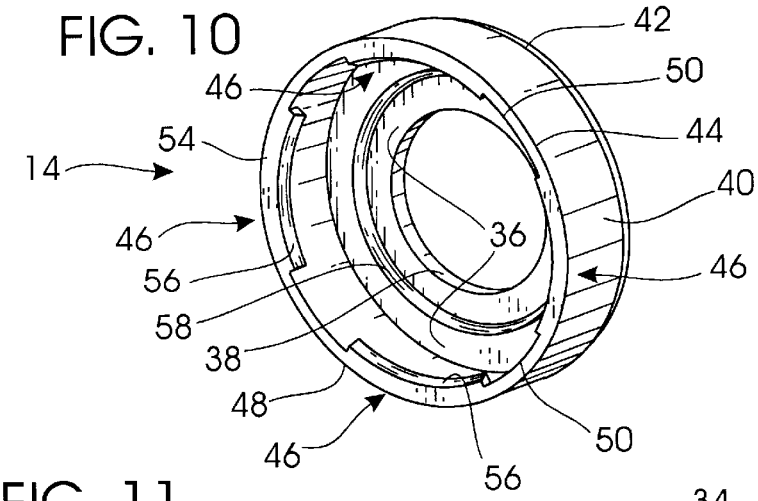
FIG. 10 is an isometric view of the snap ring of the present invention with portions removed for clarity.

Referring now to FIG. 4 in conjunction with FIG. 10, the snap ring 14 has a top surface 34 (FIG. 4), a bottom surface 36, a nipple hole 38, a sidewall 40, a sidewall top portion 42, and a sidewall bottom portion 44. The bottom surface 36 and the nipple hole 38 are more easily seen in FIG. 10. Locking ears 46 are evenly spaced around the circumference 48 of the sidewall bottom portion 44 of the snap ring 14. The evenly spaced locking ears 46 create spaces 50 between adjacent locking ears 46. Each locking ear 46 has a locking ear top surface 52, a locking ear bottom surface 54, and a locking ear bevel 56. The locking ear bottom surface 54 is more clearly shown in FIG. 15. A snap ring sealing ridge 58 (FIG. 10) extends from the snap ring bottom surface 36 to create a seal as will be discussed in detail below. The locking ears 46, the circumference 48, and the spaces 50 are more easily seen in FIG. 10.

Figure 5:
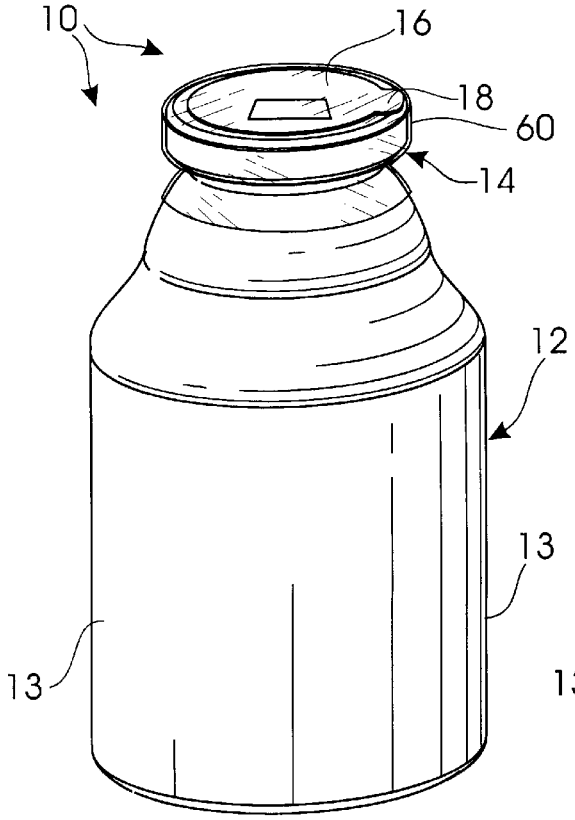
FIG. 5 is a pictorial view of the disposable non-reusable baby bottle of the present invention showing another embodiment of the safety seal.

Referring now to FIG. 5, the safety seal 16 shown in FIG 1 is held in place by an additional shrink-wrap seal 60. Shrink-wrap, which is well known in the art, is commonly used to seal food containers (e.g., mayonnaise jars) and over-the-counter drug containers (e.g., aspirin bottles).

Figure 6:
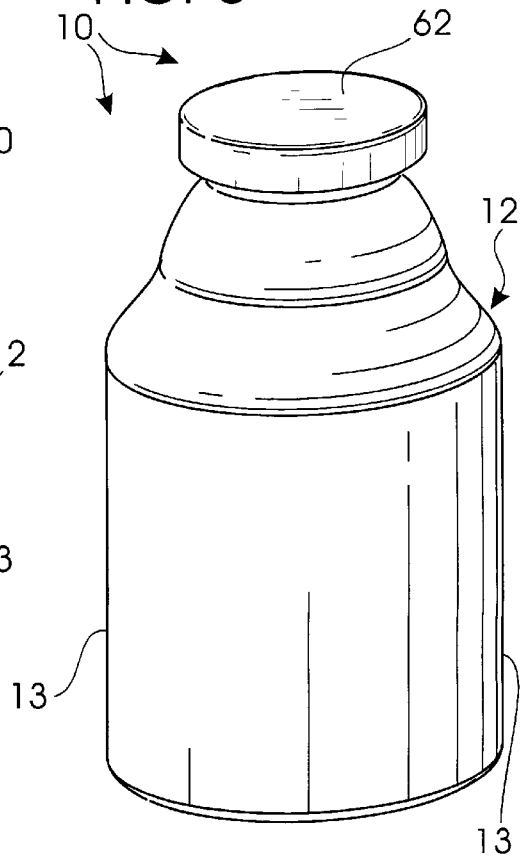
FIG. 6 is a pictorial view of the disposable non-reusable baby bottle of the present invention showing yet another embodiment of the safety seal.

Referring now to FIG. 6 in conjunction with FIG. 4, an alternate safety seal embodiment 62 consists of a circular section of aluminum foil extending across the top surface 34 and downwardly along the sidewall 40 of the snap ring 14. The aluminum foil safety seal 62 is crimped beneath the bottom surfaces 54 of the locking ears 46 and beneath a rigid flange bottom 70 of the container 12 (see FIGS. 11 and 15). To gain access to the nipple 20 of the disposable non-reusable baby bottle 10, the user must first remove the aluminum foil safety seal 62.

Figures 7, 8, 9:
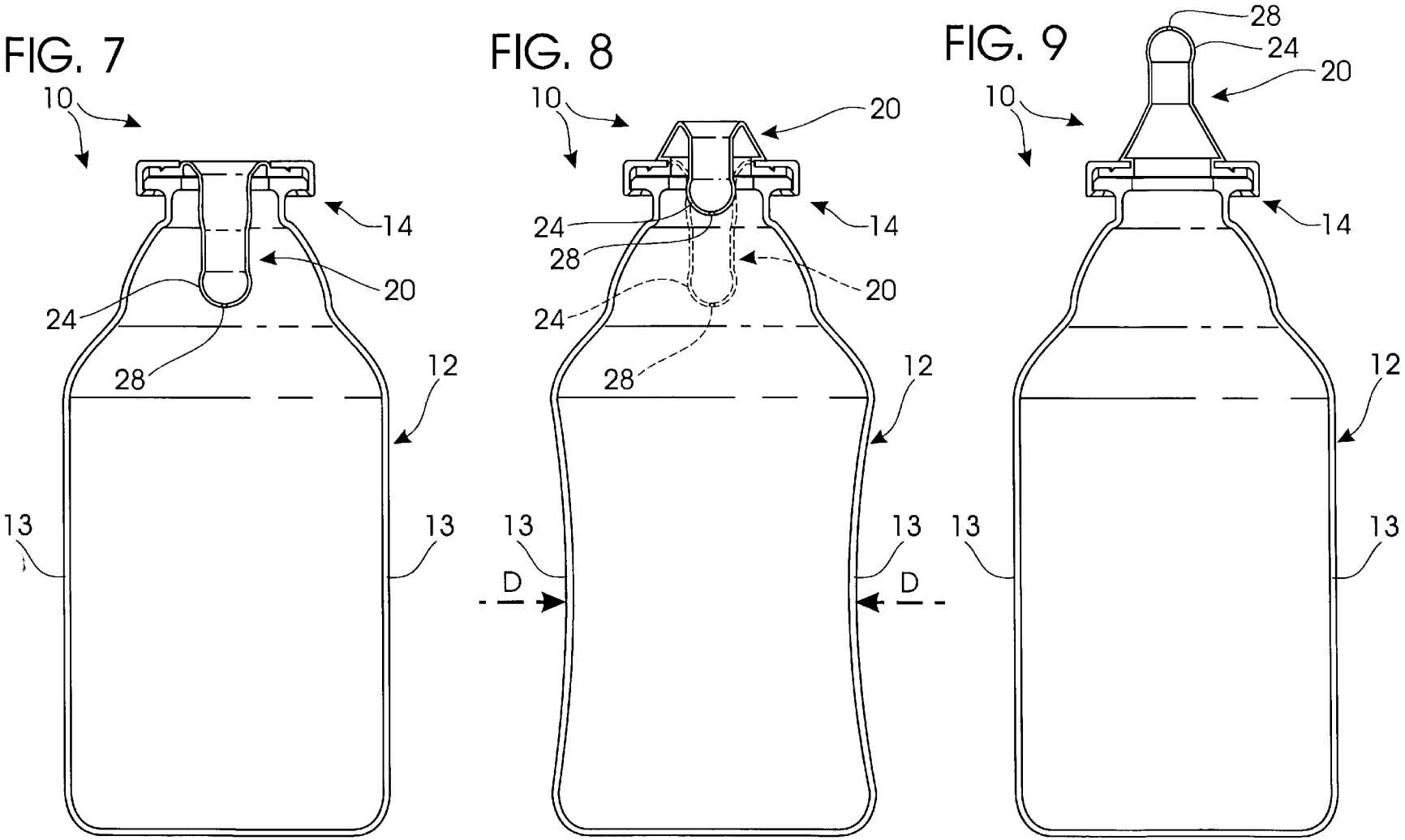
FIG. 7 is a cross-sectional view of the disposable non-reusable baby bottle of the present invention, taken generally along section lines A—A of FIG. 1, showing the nipple in a storage position.
FIG. 8 is a cross-sectional view of the disposable non-reusable baby bottle of the present invention, taken generally along section lines A—A of FIG. 1, showing the nipple in an intermediate position as a force is applied along D.
FIG. 9 is a cross-sectional view of the disposable non-reusable baby bottle of the present invention, taken generally along section lines CC of FIG. 3, showing the nipple in a ready-to-use position.

Referring now to FIGS. 7–9, the nipple 20 of the disposable non-reusable baby bottle 10 is shown in a storage position (FIG. 7), in an intermediate position (FIG. 8), and in a ready-to-use position (FIG. 9). Whether the nipple 20 is constructed from either natural or synthetic rubber, the nipple opening 28 tends to close reversibly when the nipple 20 is not in use. When the care giver squeezes the flexible sidewalls 13 of the container 12 along D, a resulting increase in pressure within the container 12 causes the nipple 20 to move from the storage position shown in FIG. 7 to the ready-to-use position shown in FIG. 9. If necessary, manipulation of the tip end 24 of the nipple 20 permits a small amount of air to enter the container 12 through the nipple opening 28, thereby relieving any partial vacuum created by the return of the flexible sidewalls 13 to their original position.

It will be understood by one skilled in the art that the nipple 20 may be inverted from the storage position to the ready-to-use position by means other than a force applied to the flexible sidewalls 13 of the container 12 along D. For example, the care giver can retrieve the nipple by placing a clean finger within the flexible tubular body 22, thereby causing the flexible tubular body 22 to expand while simultaneously biasing the flexible tubular body 22 against the care giver's finger. Then, by withdrawing his/her finger, the care giver pulls the nipple 20 from within the container 12 and places the nipple 20 in the ready-to-use position shown in FIG. 9.

Figure 15:
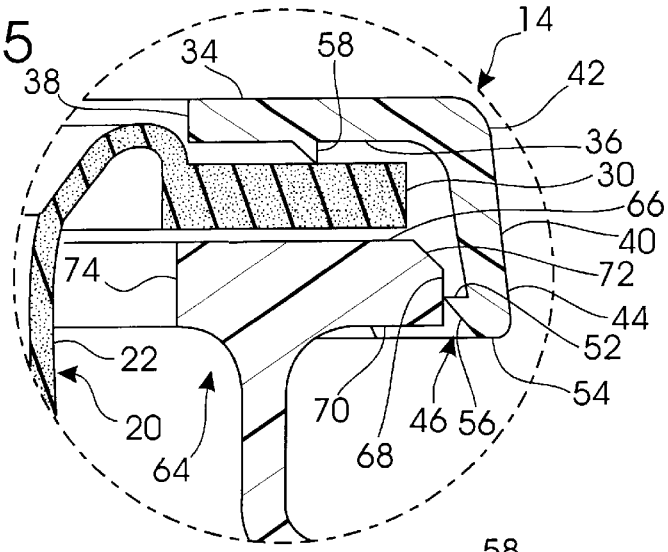
FIG. 15 is a greatly enlarged detail of a portion of FIG. 13 indicate by F.

Referring now to FIG. 10 in conjunction with FIG. 15, in the presently preferred embodiment the snap ring 14 of the present invention includes four locking ears 46 spaced evenly about the snap ring circumference 48. The adjacent locking ears 46 are separated by the spaces 50. The locking ears 46, the locking ear top surfaces 52, the locking ear bottom surfaces 54, and the locking ear bevels 56 are shown more clearly in FIG. 15. A snap ring sealing ridge 58 (FIG. 10) extends from the snap ring bottom surface 36.

Figure 11:
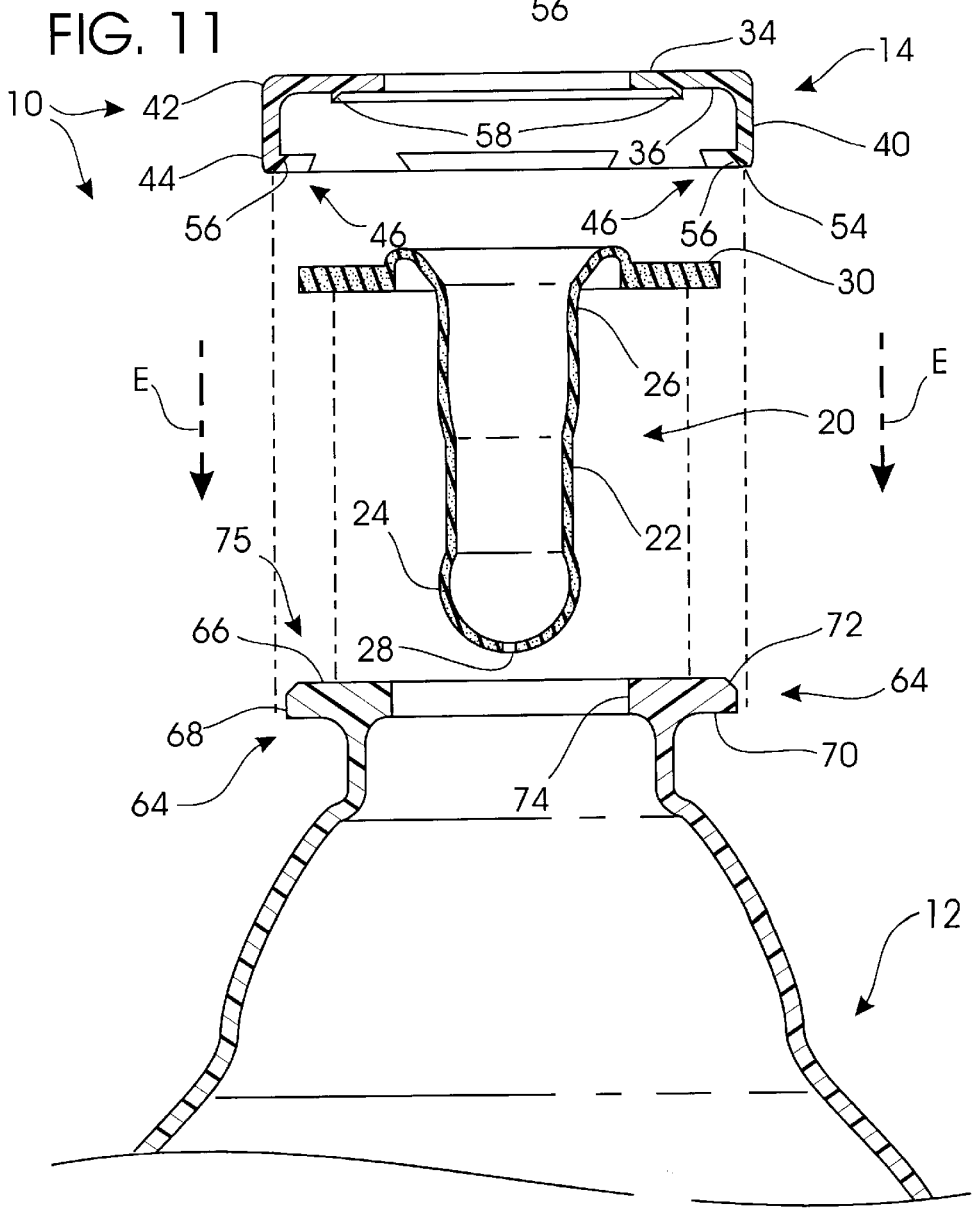
FIG. 11 is an exploded fragmentary cross-sectional view of the disposable non-reusable baby bottle of the present invention taken generally along section lines A—A of FIG. 1.

Referring now to FIG. 11, the snap ring 14, the nipple 20, and the container 12 (with bottom portion cut away) are shown in exploded view. The nipple 20 is shown in the storage position typical of assembly of the disposable non-reusable baby bottle 10 of the present invention after the container 12 is filled with a liquid. The container 12 has a rigid flange 64. The rigid flange 64 includes a rigid flange top 66, a rigid flange side 68, and a rigid flange bottom 70. A rigid flange bevel 72 connects the rigid flange top 66 and the rigid flange side 68. The container 12 includes an opening 74 formed at the open end 75 of the container 12 by the rigid flange 64. The container opening 74 serves a dual purpose. First, the container opening 74 permits filling of the disposable non-reusable baby bottle 10 prior to installation of the nipple 20 and the snap ring 14. In addition, the container opening 74 provides a space in which the tip end 24 is inverted through the flexible tubular portion 22 of the nipple 20 for storage within the open end 75 of the container 12 until the disposable non-reusable baby bottle 10 is ready for use.

Still referring to FIG. 11, the disposable non-reusable baby bottle 10 is assembled by placing the nipple 20 within the container opening 74 and the open end 75 of the container 12 with the radially enlarged flange 30 of the nipple 20 resting on the rigid flange top 66. The snap ring 14 is placed over the radially enlarged flange 30 of the nipple 20 so that the radially enlarged flange 30 is positioned between the rigid flange top 66 and the snap ring bottom surface 36. The snap ring locking ear bevels 56 are aligned with the rigid flange bevel 72.

Referring now to FIGS. 11–14, as the snap ring 14 is forced downwardly against the rigid flange 64 in the direction of the arrow E, the rigid flange bevel 72 causes the locking ears 46 of the snap ring 14 to flex outwardly. As additional force is applied by pressing the snap ring 14 downwardly against the rigid flange 64, the radially enlarged flange 30 of the nipple 20 is compressed and the snap ring sealing ridge 58 protrudes into the radially enlarged flange 30. When the locking ears 46 clear the rigid flange bottom 70, the locking ears 46 flex inwardly to return to their original configuration so that the locking ear top surfaces 52 rest against the rigid flange bottom 70. Compression of the radially enlarged flange 30 of the nipple 20 causes the locking ear top surfaces 52 to be biased against the rigid flange bottom 70. Thus the locking ears 46 "snap" into place against the rigid flange bottom 70.

Figure 12:
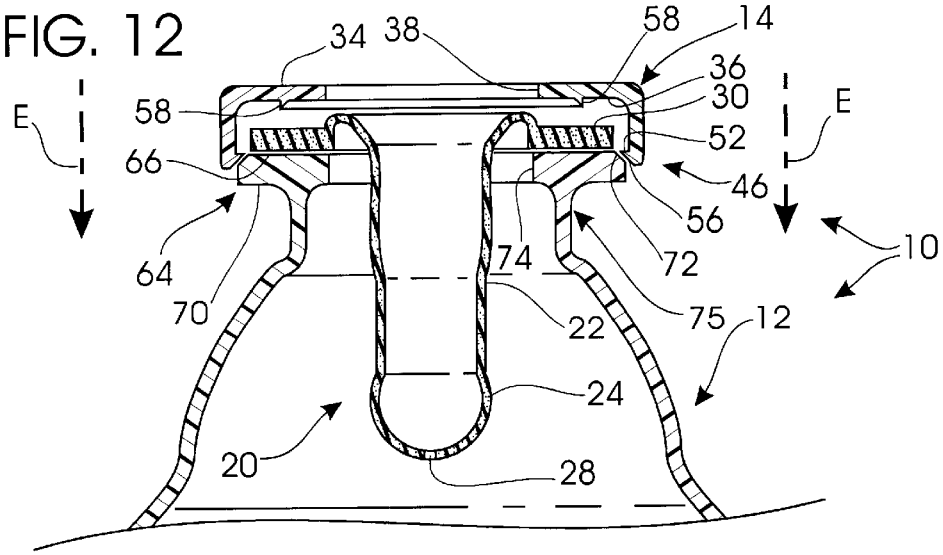
FIG. 12 is an exploded fragmentary cross-sectional view of the disposable non-reusable baby bottle of the present invention, taken generally along section lines A—A of FIG. 1, showing the snap ring and the nipple as the snap ring is pressed toward the container by a force applied along E.
Figure 13:
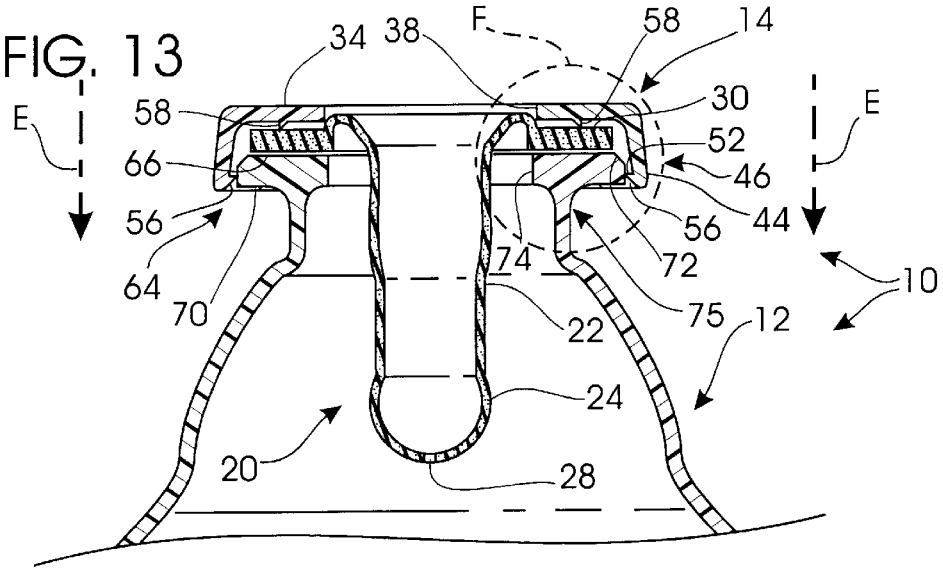
FIG. 13 is an exploded fragmentary cross-sectional view of the disposable non-reusable baby bottle of the present invention, taken generally along section lines A—A of FIG. 1, showing the snap ring and the nipple as the snap ring is pressed onto the container by application of a force along E.
Figure 14:
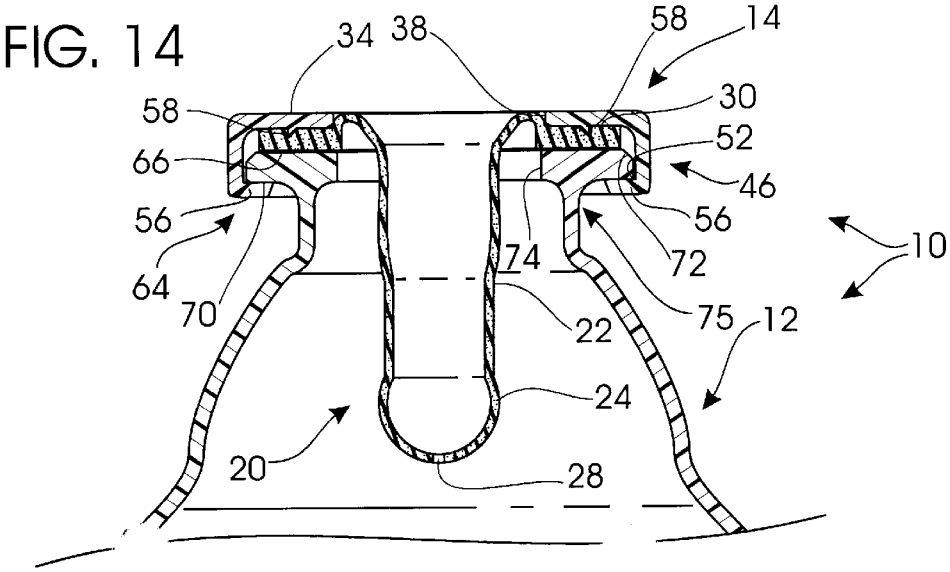
FIG. 14 is an exploded fragmentary cross-sectional view of the disposable non-reusable baby bottle of the present invention, taken generally along section lines A—A of FIG. 1, showing the disposable non-reusable baby bottle of the present invention following installation of the nipple and the snap ring onto the container.

Referring now to FIGS. 12–14, assembly of the snap ring 14, the nipple 20, and the container 12 is shown step by step. In FIG. 12, the snap ring 14 is positioned immediately above the rigid flange top 66 of the container 12 with the radially enlarged flange 30 of the nipple 20 positioned between the snap ring bottom surface 36 and the rigid flange top 66. The locking ear bevels 56 are aligned with the rigid flange bevel 72 so that, as the snap ring 14 is pressed downwardly toward the rigid flange 64 along E, the locking ears 46 first flex outwardly (FIG. 13) and then, after the locking ears 46 move downwardly past the rigid flange bottom 70, the locking ears 46 flex inwardly to return to their original position with the locking ear top surfaces 52 resting against the rigid flange bottom 70 (FIG. 14).

Referring now to FIG. 15, a detail of the portion indicated by F in FIG. 13 shows a portion of the snap ring 14, a portion of the nipple 20, and a portion of the rigid flange 64 of the container 12. The bottom portion 44 of the snap ring 14 is in the position indicated in FIG. 13, that is, the sidewall bottom portion 44 of the sidewall 40 of the snap ring 14 has flexed outwardly to permit the locking ear 46 to move downwardly along the rigid flange side 68. The locking ear top surface 52, the locking ear bottom surface 54, and the locking ear bevel 56 are shown just before the locking ear top surface 52 snaps into place under the rigid flange bottom 70.

Still referring to FIG. 15, the snap ring sealing ridge 58 of the snap ring 14 is in contact with the radially enlarged flange 30 of the nipple 20. The flexible tubular portion 22 of the nipple 20, is disposed within the container opening 74.

The snap ring 14 can be made of a variety of materials including, without limitation, metal, nylon, and molded plastic. The number of locking ears 46 in the present invention varies. For a snap ring 14 machined from nylon, four locking ears 46 are about optimum. Each of the four locking ears 46 extends about 0.50 inches along the snap ring circumference 48 (FIG. 10). Nylon snap rings 14 are comparatively brittle, and snap rings 14 molded from polyester, for example, will produce locking ears 46 which can flex farther than nylon without breaking, thereby permitting the use of three—or even two—locking ears 46.

In the presently preferred embodiment, the snap ring sealing ridge 58 extends about 0.030 inches from the snap ring bottom surface 36 (see FIG. 15). The radially enlarged flange 30 of a standard nipple, as defined above, is generally about one-eighth (0.125) inch thick, so the snap ring sealing ridge 58 protrudes into the radially enlarged flange 30 of the nipple 20 about 25% of the radially enlarged flange 30 thickness.

Figure 16:
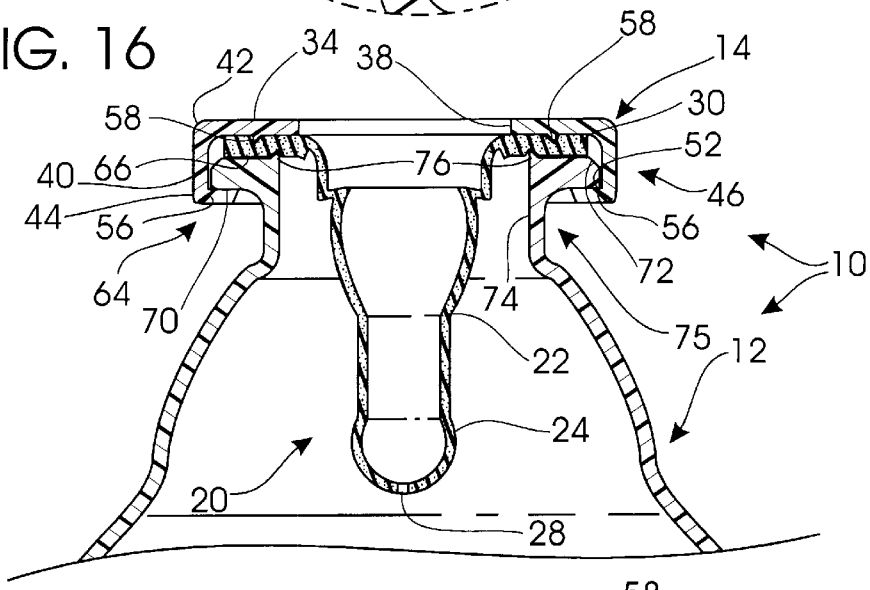
FIG. 16 is an exploded fragmentary cross-sectional view of the disposable non-reusable baby bottle of the present invention, taken generally along section lines A—A of FIG. 1, showing an alternate embodiment of a rigid flange for the container of the disposable non-reusable baby bottle of the present invention.

Referring now to FIG. 16, the rigid flange 64 of the container 12 includes a rigid flange sealing ridge 76 located on the rigid flange top 66 adjacent the container opening 74 of the container 12. As illustrated, the rigid flange sealing ridge 76 protrudes into the radially enlarged flange 30 of the nipple 20 to further secure the nipple 20 between the seal ring 14 and the rigid flange top 66.

Figure 17:
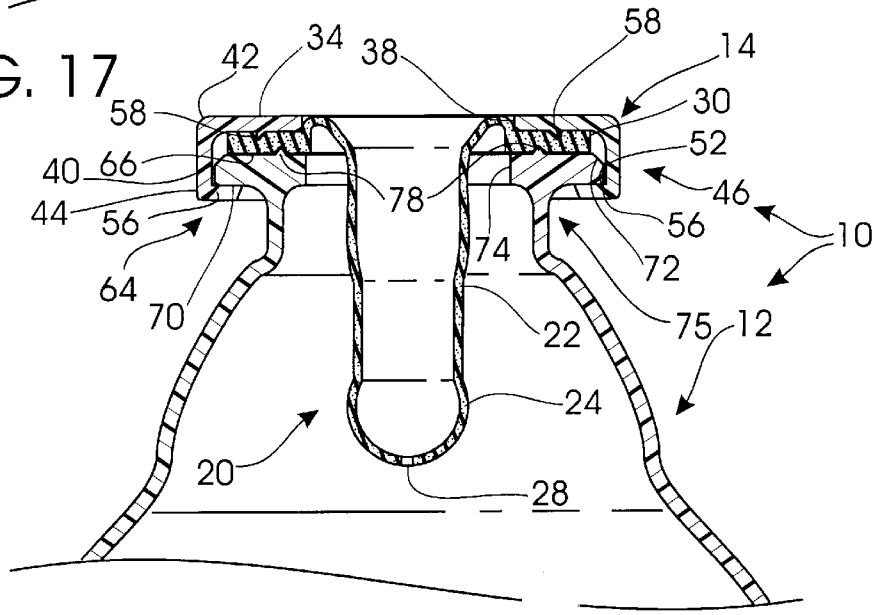
FIG. 17 is an exploded fragmentary cross-sectional view of the disposable non-reusable baby bottle of the present invention, taken generally along section lines A—A of FIG. 1, showing another alternate embodiment of a rigid flange for the container of the disposable non-reusable baby bottle of the present invention.

Referring now to FIG. 17, the rigid flange 64 of the container 12 includes another embodiment of a rigid flange sealing ridge 78 located on the rigid flange top 66 between the container opening 74 of the container 12 and the snap ring sealing ridge 58. The rigid flange sealing ridge 78 protrudes into the radially enlarged flange 30 of the nipple 20 to further secure the nipple 20 between the seal ring 14 and the rigid flange top 66.

In FIG. 16, the snap ring sealing ridge 58 and the rigid flange sealing ridge 76 cooperate to secure the radially enlarged flange 30 of the nipple 20 between the seal ring 14 and the rigid flange top 66. In FIG. 17, the snap ring sealing ridge 58 and the rigid flange sealing ridge 78 cooperate to secure the radially enlarged flange 30 of the nipple 20 between the seal ring 14 and the rigid flange top 66. Removal of the nipple 20 from the assembled disposable non-reusable baby bottle 10 by force applied to the nipple 20 normally destroys the nipple 20. As a result, the disposable non-reusable baby bottle 10 of the present invention is a non-reusable baby bottle. Once assembled, the present invention can not be disassembled. Once removed from the assembled disposable non-reusable baby bottle 10, the nipple 20 can not be reinstalled.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A disposable non-reusable baby bottle for feeding liquid to a nursing infant, comprising:

a generally cylindrical container having an open end formed by a rigid flange, said rigid flange characterized as having a rigid flange top, a rigid flange side, a rigid flange bottom, and a rigid flange bevel connecting said rigid flange top with said rigid flange side;

a nipple formed of compressible material, said nipple comprising:

a flexible tubular body having a tip end for insertion in the infant's mouth and a base end, said tip end being invertible within said base between a use position wherein said tip end extends upwardly to fit in the infant's mouth and a storage position wherein said tip end extends downwardly through said base end for storage, said tip end having a nipple opening for flow of the liquid through said nipple from said bottle in response to the infant's sucking action on said tip end; and a radially enlarged flange on said base end for attaching said nipple to said open end of said container; and locking means for locking said nipple to said open end of said container, said locking means comprising:

a snap ring having a top, a bottom, a nipple hole between said top and bottom, and a sidewall, said snap ring sidewall further characterized as having a sidewall top portion, a sidewall bottom portion, and a snap ring circumference distal from said snap ring top; and said snap ring further having a plurality of locking ears integrally formed with said sidewall bottom portion of said snap ring sidewall and extending inwardly from said snap ring sidewall, said locking ears being evenly spaced around said snap ring sidewall bottom portion of said snap ring so that said plurality of said locking ears are separated by a plurality of spaces between said locking ears, said locking ears being flexible between an at-rest position and a spread position, each said locking ear having a locking ear top surface and a locking ear bottom surface, said locking ear bottom surface further including a locking ear bevel, so that said radially enlarged flange of said base end of said nipple mates with said bottom of said snap ring and, as force is applied on said top of said snap ring to force said snap ring onto said open end of said container, said locking ear bevels engage said rigid flange bevel, thereby causing said locking ears to flex outwardly away from said rigid flange side to said spread position, and, further, as said snap ring bottom is pressed against said radially enlarged flange on said nipple and said radially flange is pressed against said open end rigid flange top, said radially enlarged flange on said nipple is compressed between said snap ring and said cylindrical container rigid flange top and said locking ears flex inwardly to return to said at-rest position wherein said locking ear top surfaces rest against said rigid flange bottom of said open end of said cylindrical container, said locking ear top surfaces being biased against said rigid flange bottom of said open end of said container as a result of the compression of said radially enlarged flange of said base end of said nipple, so that said nipple is locked against said open end of said container.

2. The disposable non-reusable baby bottle of claim 1, wherein said cylindrical container is molded from plastic.

3. The disposable non-reusable baby bottle of claim 1 wherein said snap ring includes a snap ring sealing ridge on said bottom of said snap ring, said snap ring sealing ridge extending from said bottom of said snap ring so that, as said snap ring bottom is pressed against said radially enlarged flange on said nipple and said radially enlarged flange on said nipple is pressed against said rigid flange top, said snap ring sealing ridge on said bottom of said snap ring protrudes into said radially enlarged flange on said nipple to provide a further seal between said snap ring and said radially enlarged flange so that, after said nipple is locked against said open end of said container, said snap ring sealing ridge provides increased resistance to removal of said nipple from said container.

4. The disposable non-reusable baby bottle of claim 3 wherein said snap ring includes three locking ears evenly spaced around said snap ring sidewall bottom portion so that adjacent locking ears are separated by a space therebetween.

5. The disposable non-reusable baby bottle of claim 3 wherein said snap ring includes four locking ears evenly spaced around said snap ring sidewall bottom portion so that adjacent locking ears are separated by a space therebetween.

6. The disposable non-reusable baby bottle of claim 3 wherein said snap ring sealing ridge extends about 0.030 inches from said bottom of said snap ring.

7. The disposable non-reusable baby bottle of claim 3 wherein said locking means further comprises a rigid flange sealing ridge on said rigid flange top, said rigid flange sealing ridge extending from said rigid flange top so that, as said radially enlarged flange on said nipple is pressed against said cylindrical rigid flange top, said rigid flange sealing ridge on said rigid flange top protrudes into said radially enlarged flange on said nipple to provide a further seal between said rigid flange top and said radially enlarged flange on said nipple so that, after said nipple is locked against said open end of said container, said rigid flange sealing ridge provides increased resistance to removal of said nipple from said container.

8. The disposable non-reusable baby bottle of claim 3, further comprising a safety seal affixed to said top of said snap ring to protect said nipple from contamination by foreign matter when said nipple is in said storage position.

9. The disposable non-reusable baby bottle of claim 1 wherein said snap ring includes four locking ears evenly spaced around said snap ring sidewall bottom portion so that adjacent locking ears are separated by a space therebetween.

10. The disposable non-reusable baby bottle of claim 9 wherein said snap ring is about 1.75 inches in diameter and wherein each of said four locking ears extends inwardly from said snap ring sidewall bottom portion along about 0.5 inches of the snap ring circumference.

11. The disposable non-reusable baby bottle of claim 1 wherein said rigid flange bevel forms an angle of about 45 degrees with respect to said rigid flange side.

12. The disposable non-reusable baby bottle of claim 1 wherein said locking ear bevel forms an angle of about 45 degrees with respect to said locking ear top surface.

13. The disposable non-reusable baby bottle of claim 1 wherein said snap ring includes three locking ears evenly spaced around said snap ring sidewall bottom portion so that adjacent locking ears are separated by a space therebetween.

14. The disposable non-reusable baby bottle of claim 1, wherein said cylindrical container further comprises flexible sidewalls so that, when said nipple is in said storage position, deflection of said flexible sidewalls inwardly causes said nipple to move from said storage position to said use position.

15. The disposable non-reusable baby bottle of claim 1, further comprising a safety seal affixed to said top of said snap ring to protect said nipple from contamination by foreign matter when said nipple is in said storage position.

16. The disposable non-reusable baby bottle of claim 15, wherein said safety seal consists of aluminum foil removably glued to said top of said snap ring.

17. The disposable non-reusable baby bottle of claim 15, wherein said safety seal consists of aluminum foil extending across said top and downwardly along said sidewall of said snap ring so that said aluminum foil is removably crimped beneath said bottom surfaces of said locking ears and beneath said rigid flange bottom.

18. The disposable non-reusable baby bottle of claim 15, wherein said safety seal consists of shrink-wrap plastic extending across said top and downwardly along said sidewall of said snap ring so that said shrink-wrap plastic is removably secured beneath said bottom surfaces of said locking ears and beneath said rigid flange bottom.

* * * * *